US008166717B2

(12) United States Patent
Kim

(10) Patent No.: US 8,166,717 B2
(45) Date of Patent: May 1, 2012

(54) STIFFENER FOR CONNECTING PRESTRESSED CONCRETE BEAM AND METHOD OF CONSTRUCTING STRUCTURE USING THE SAME

(75) Inventor: Jeom Han Kim, Gyeonggi-do (KR)

(73) Assignees: Cross Structural Consultant Co., Ltd., Seoul (KR); Jeom Han Kim, Gyeonggi-Do (KR)

( * ) Notice: Subject to any disclaimer, the term of this patent is extended or adjusted under 35 U.S.C. 154(b) by 0 days.

(21) Appl. No.: 12/993,247

(22) PCT Filed: May 15, 2009

(86) PCT No.: PCT/KR2009/002592

§ 371 (c)(1),
(2), (4) Date: Nov. 17, 2010

(87) PCT Pub. No.: WO2009/142416

PCT Pub. Date: Nov. 26, 2009

(65) Prior Publication Data

US 2011/0094182 A1 Apr. 28, 2011

(30) Foreign Application Priority Data

May 19, 2008 (KR) ..... 10-2008-0046053

(51) Int. Cl.
*E04B 1/21* (2006.01)
*E04B 5/04* (2006.01)

(52) U.S. Cl. ..... 52/326; 52/289; 52/334; 52/741.1; 52/601; 403/295; 403/310

(58) Field of Classification Search ..... 52/272, 52/283, 289, 414, 319, 326, 327, 334, 741.1, 52/250, 251, 432–435, 601, 649.2, 223.13; 403/205, 248–251, 264, 295, 302, 310–313
See application file for complete search history.

(56) References Cited

U.S. PATENT DOCUMENTS

| | | | | | |
|---|---|---|---|---|---|
| 1,538,218 | A | * | 5/1925 | Seelye | 52/704 |
| 2,208,814 | A | * | 7/1940 | Peabody | 52/285.1 |
| RE23,074 | E | * | 1/1949 | Henderson | 52/283 |
| 2,724,261 | A | * | 11/1955 | Rensaa | 52/295 |
| 3,210,900 | A | * | 10/1965 | Sattler | 52/334 |
| 3,261,135 | A | * | 7/1966 | Knabe | 52/127.12 |
| 3,513,610 | A | * | 5/1970 | Devonport | 52/283 |
| 3,733,757 | A | * | 5/1973 | Scott | 52/105 |
| 3,993,341 | A | * | 11/1976 | Bentley | 294/89 |
| 4,104,844 | A | * | 8/1978 | Brownlee | 52/742.15 |
| 4,111,584 | A | * | 9/1978 | Fyfe | 404/69 |
| 4,171,173 | A | * | 10/1979 | Hymans | 403/189 |

(Continued)

FOREIGN PATENT DOCUMENTS

EP 318712 A1 * 6/1989

(Continued)

*Primary Examiner* — Robert Canfield
*Assistant Examiner* — Brent W Herring
(74) *Attorney, Agent, or Firm* — J.C. Patents

(57) ABSTRACT

Provided are a stiffener for connecting a prestressed concrete beam and a method of constructing a structure using the same, in which the beam such as the prestressed concrete beam which is covered with concrete is connected to a target structure including a column structure or a girder. The stiffener is made up of a buried stiffener, an end face stiffener, and a joint stiffener, thereby enabling simple connection, excellent stress transmission, and very efficient construction of (building) structures.

8 Claims, 13 Drawing Sheets

U.S. PATENT DOCUMENTS

| | | | | | |
|---|---|---|---|---|---|
| 4,196,558 | A | * | 4/1980 | Jungbluth | 52/649.2 |
| 4,211,045 | A | * | 7/1980 | Koizumi et al. | 52/251 |
| 4,329,826 | A | * | 5/1982 | Flogaus et al. | 52/712 |
| 4,696,137 | A | * | 9/1987 | Schleich | 52/251 |
| 4,804,292 | A | * | 2/1989 | DeLuca | 404/69 |
| 4,951,438 | A | * | 8/1990 | Thoresen | 52/252 |
| 4,982,537 | A | * | 1/1991 | Matikainen | 52/251 |
| 5,113,631 | A | * | 5/1992 | diGirolamo et al. | 52/236.8 |
| 5,152,112 | A | * | 10/1992 | Eustace | 52/223.8 |
| 5,216,860 | A | * | 6/1993 | Thomson et al. | 52/259 |
| 5,311,629 | A | * | 5/1994 | Smith | 14/73.1 |
| 5,342,138 | A | * | 8/1994 | Saito et al. | 403/189 |
| 5,467,569 | A | * | 11/1995 | Chiodo | 52/713 |
| 5,660,017 | A | * | 8/1997 | Houghton | 52/655.1 |
| 6,494,639 | B1 | * | 12/2002 | Friend | 403/403 |
| 6,679,017 | B2 | * | 1/2004 | Woodruff et al. | 52/283 |
| 6,739,099 | B2 | * | 5/2004 | Takeuchi et al. | 52/167.1 |
| 2003/0093961 | A1 | * | 5/2003 | Grossman | 52/250 |
| 2003/0131547 | A1 | * | 7/2003 | Woodruff et al. | 52/283 |

FOREIGN PATENT DOCUMENTS

| | | | | |
|---|---|---|---|---|
| JP | 04-016653 | | | 1/1992 |
| JP | 06-185108 | | | 7/1994 |
| JP | 07090933 | A | * | 4/1995 |
| JP | 07216981 | A | * | 8/1995 |
| JP | 09296508 | A | * | 11/1997 |
| JP | 2000303558 | A | * | 10/2000 |
| JP | 2009091844 | A | * | 4/2009 |
| KR | 100673475 | | | 1/2007 |

* cited by examiner

STIFFENER FOR CONNECTING PRESTRESSED CONCRETE BEAM AND METHOD OF CONSTRUCTING STRUCTURE USING THE SAME

BACKGROUND

1. Field

The present invention relates to a stiffener for connecting a prestressed concrete beam and a method of constructing a structure using the same, and more particularly, to a stiffener for connecting a prestressed concrete beam and a method of constructing a structure using the same, capable of facilitating connection of a beam such as a prestressed concrete beam which is covered with concrete with a steel frame or another structure (e.g. a column, a beam, or a target structure) which is covered with concrete, smoothly transmitting a stress, and securing connection constructability and structural safety with respect to the target structure.

2. Description of the Related Art

Particularly, FIG. 1 illustrates the connection of a column structure 10 made of reinforced concrete with a prestressed concrete beam 20 in the related art.

Since both the column structure 10 and the prestressed concrete beam 20 are covered with concrete, there are many difficulties in the connection thereof without separate connecting means.

As such, one lateral face of the column structure 10 made of reinforced concrete in the related art is cut out to form a cavity S, and a bottom face of one end of the prestressed concrete beam 20 is placed on a bottom face of the cut cavity S. Thereby, both are connected to each other.

However, because the cut cavity S should be separately formed in the lateral face of the column structure 10, this connecting method is accompanied with much inconvenience in that this should be taken into consideration when the column structure is made.

Since the prestressed concrete beam 20 is placed in the cut cavity S, a stress transmitted from the beam due to a dead load of the beam is concentrated on the column structure. For this reason, there is a possibility of cracks being generated from the concrete around the cavity, and thus it is necessary to separately reinforce the cavity.

Further, it is impossible to sufficiently secure connectability of the column structure 10 and the prestressed concrete beam 20, and thus structural safety is not guaranteed.

SUMMARY

In order to solve the problems, the present invention is directed to a stiffener for connecting a prestressed concrete beam and a method of constructing a structure using the same, capable of providing efficient stress transmission and promoting constructability of the connection with another structure.

According to an exemplary aspect, there is provided a stiffener for connecting a prestressed concrete beam, which includes: a buried stiffener that is installed on an end face of the prestressed concrete beam covered with concrete so as to protrude inwards from the end face of the prestressed concrete beam to transmit a stress transmitted from the prestressed concrete beam; an end face stiffener that is connected to a front face of the buried stiffener and is installed so as to be in contact with the end face of the prestressed concrete beam; and a joint stiffener that protrudes from a front face of the end face stiffener in a lengthwise direction of the prestressed concrete beam, thereby allowing the prestressed concrete beam to be connected to a target structure in a simple manner Thus, the stiffener of the present invention allows a stress caused by weight to be more smoothly transmitted by the buried stiffener, and facilitates connection to the target structure due to the end face stiffener connected with the joint stiffener.

The end face stiffener may be formed on top, bottom, and opposite lateral faces of the prestressed concrete beam, so that the stiffener of the present invention allows a stress acting on an end of the prestressed concrete beam to be more effectively transmitted to the target structure and is allowed to be reinforced along with the end of the prestressed concrete beam.

A connecting member may be installed on the target structure so as to be able to be connected with the prestressed concrete beam connecting stiffener of the present invention, wherein the connecting member makes it easy to secure constructability and connectability, for instance, by mechanical fastening such as bolt and nut fastening to the joint stiffener having bolt holes.

A building structure may be constructed using the aforementioned prestressed concrete beam connecting stiffener. Thereby, the building structure can be more rapidly constructed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the aspects of the invention.

DETAILED DESCRIPTION

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art.

FIGS. 2*a*, 2*b*, 2*c*, 2*d* and 2*e* illustrate embodiments (first to fifth embodiments) of the present invention in connection with a stiffener 100 for connecting a prestressed concrete beam.

First Embodiment

Figure 1:
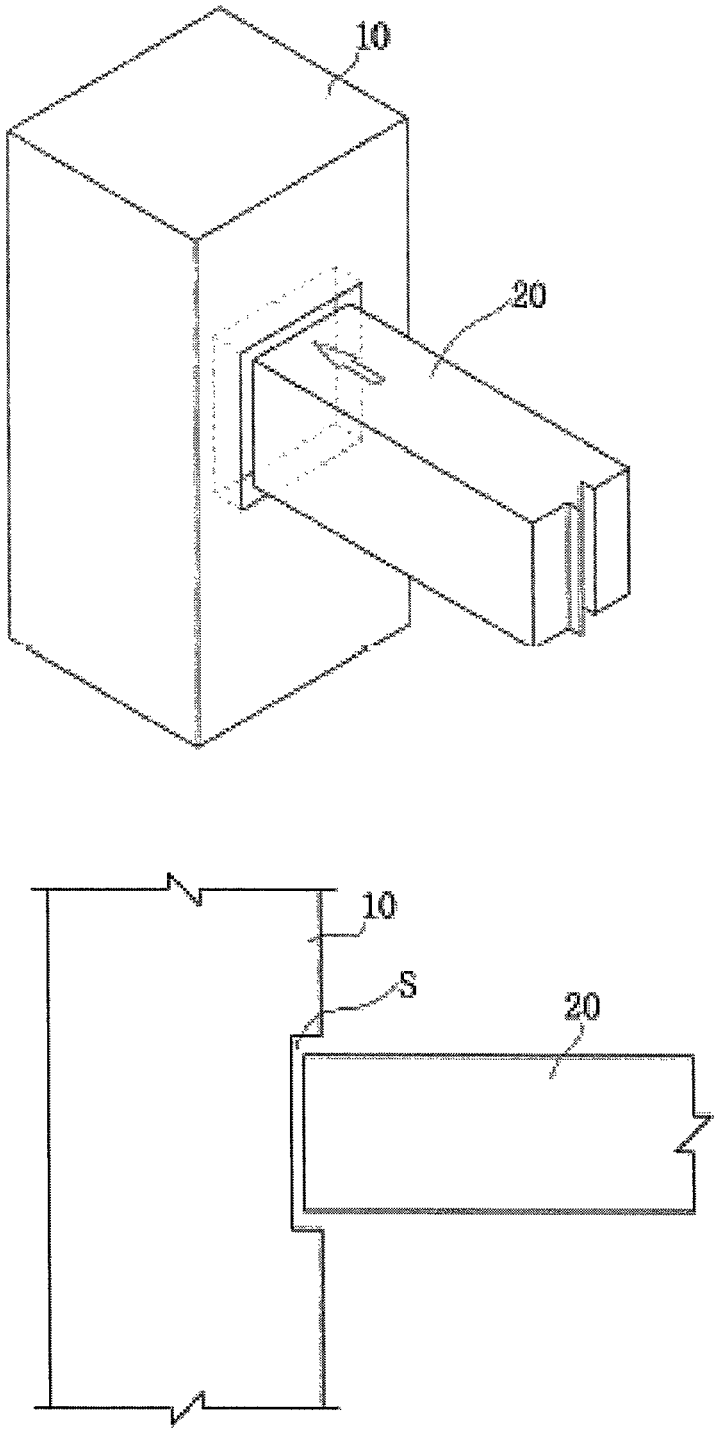
FIG. 1(RELATED ART)
FIG. 1 illustrates an example of conventional connection of a prestressed concrete beam and a column structure.
Figure 2A:
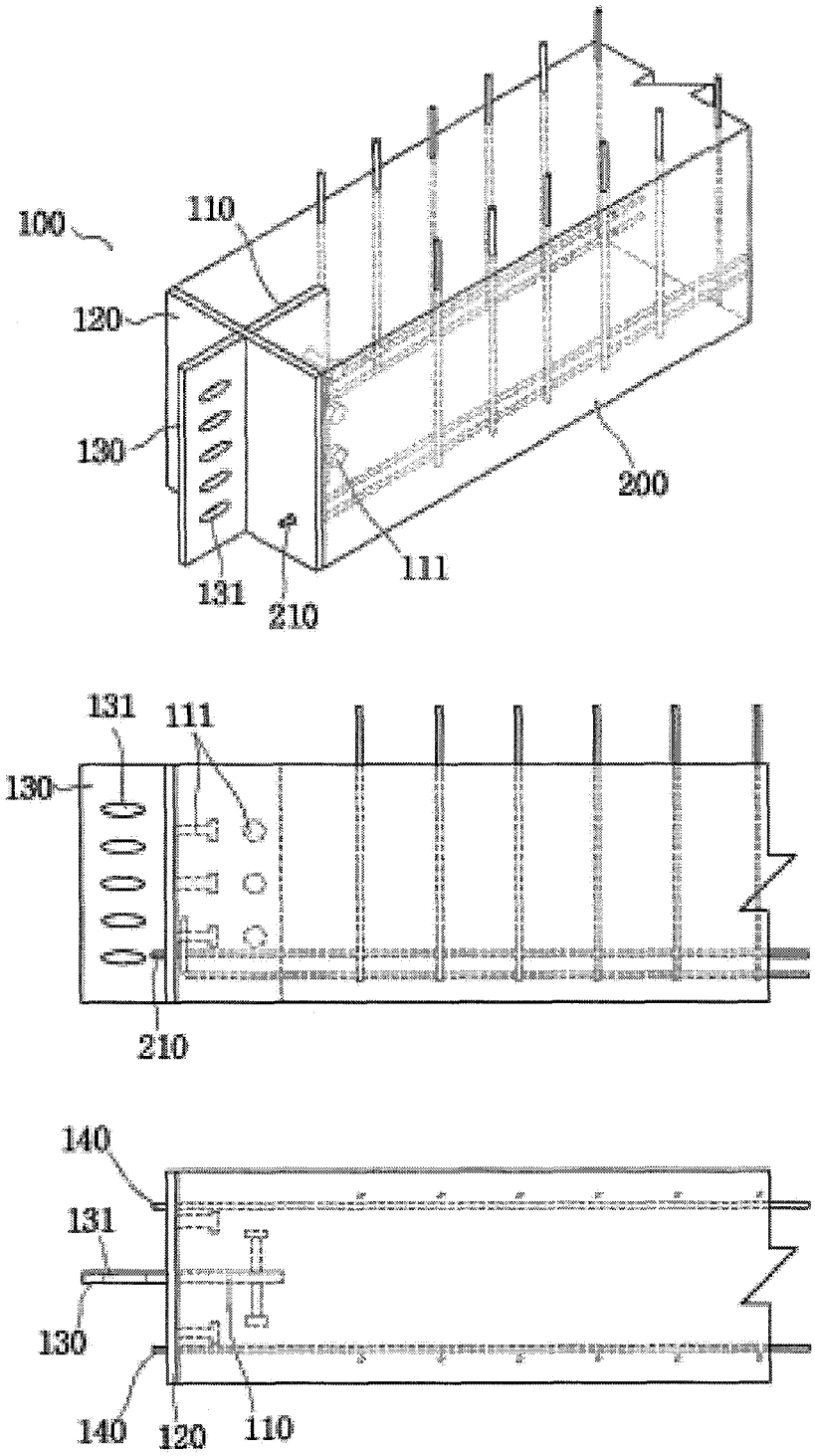
FIGS. 2*a*, 2*b*, 2*c*, 2*d* and 2*e* illustrate embodiments of a prestressed concrete beam connecting stiffener of the present invention.

Referring to FIG. 2*a*, the stiffener 100 for connecting a prestressed concrete beam generally includes a buried stiffener 110, an end face stiffener 120, and a connection stiffener 130, all of which are integrally formed.

The buried stiffener 110 extends from approximately a middle of one end face of a prestressed concrete beam (including a precast reinforced concrete beam) 200 so as to be buried in the prestressed concrete beam 200. That is, the buried stiffener 110 is installed so as to be buried in the prestressed concrete beam 200.

Typically, the buried stiffener 110 may be made of a steel plate, and has a quadrilateral shape as in FIG. 2*a*. However, the buried stiffener 110 may have a triangular shape. If there is no problem with disposition, one, two or more buried stiffeners 110 may be installed.

Furthermore, a buried depth of the buried stiffener 110 may be decided in consideration of a cross-sectional size, etc. of the prestressed concrete beam 200.

Further, the buried stiffener 110 may be additionally provided with studs 111, shear connectors, on opposite sides thereof. The studs 111 are buried in the prestressed concrete beam 200, so that the prestressed concrete beam connecting stiffener 100 of the present invention is also able to be effectively merged (integrated) into the prestressed concrete beam 200.

This buried stiffener 110 functions to distribute and transmit stress, which is generated by load acting on the prestressed concrete beam 200, to the end face stiffener 120 and the joint stiffener 130, both of which will be described below.

Further, the buried stiffener 110 is buried in the end of the prestressed concrete beam 200, and also serves to reinforce the end of the prestressed concrete beam 200.

The end face stiffener 120 is connected to a front face of the buried stiffener 110 so as to be in contact with one end face of the prestressed concrete beam 200.

In detail, the end face stiffener 120 is installed to cover one end face of the prestressed concrete beam 200 and to be integrally connected with the front face of the buried stiffener 110 in approximately a middle of the rear face thereof This end face stiffener 120 may also be made of a steel plate, and has a quadrilateral shape as in FIG. 2*a*. However, the end face stiffener 120 may be modified depending on the shape of the end face of the prestressed concrete beam 200.

The end face stiffener 120 functions to receive the stress transmitted from the buried stiffener 110 and to transmit it to a target structure 300 via the joint stiffener 130 that will be described below.

Further, the end face stiffener 120 serves as an anchorage plate such that tendons 210 such as prestressing (PS) strands disposed in the prestressed concrete beam 200 as in FIG. 2*a* can be prestressed and anchored.

The end face stiffener 120 is also additionally provided with studs 111, shear connectors, on the rear face thereof. The studs 111 are buried in the prestressed concrete beam 200, so that the prestressed concrete beam connecting stiffener 100 of the present invention is also able to be effectively merged (integrated) into the prestressed concrete beam 200.

The joint stiffener 130 protrudes from the front face of the end face stiffener 120 so as to be symmetrical with the buried stiffener 110, which is connected to the rear face of the end face stiffener 120, about the end face stiffener 120.

The joint stiffener 130 may also be made of a steel plate, and has a quadrilateral shape as in FIG. 2*a*. However, the joint stiffener 130 is not substantially limited in its shape, and need only be formed in such a size that it can secure connectability to the target structure.

This joint stiffener 130 is provided with a plurality of bolt holes, which are used for fasteners made up of bolts and nuts. The bolt holes are preferably formed in an elliptical slot shape so as to be able to adjust a fastening position of each fastener.

Further, the joint stiffener 130 basically functions to receive the stress transmitted from the buried stiffener 110 and the end face stiffener 120 and to transmit it to the target structure 300.

In addition, the joint stiffener 130 serves as a member for directly connecting the prestressed concrete beam 200 with a connecting member 400 of the target structure 300.

The prestressed concrete beam connecting stiffener 100 made up of the buried stiffener 110, the end face stiffener 120, and the joint stiffener 130 discussed above is prefabricated so as to be set to the end face of the prestressed concrete beam 200, so that it can be installed along with the prestressed concrete beam 200 when the prestressed concrete beam 200 is fabricated by arranging reinforcements and pouring and curing concrete.

Accordingly, it can be found that the prestressed concrete beam connecting stiffener 100 is previously mounted on one or opposite end faces of the prestressed concrete beam 200.

Second Embodiment

Figure 2B:
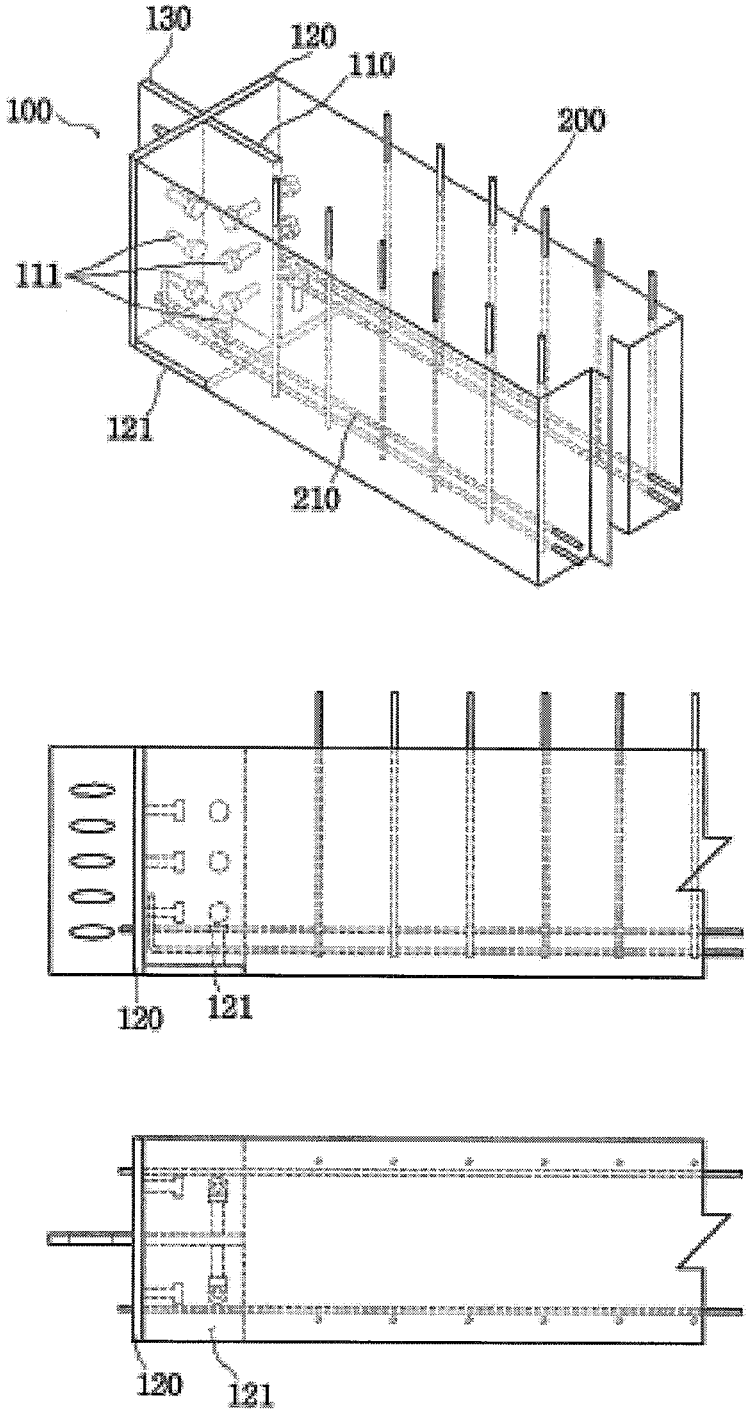

The prestressed concrete beam connecting stiffener 100 of the present invention as illustrated in FIG. 2*b* is basically identical to that of the first embodiment, but different from that of the first embodiment in that the end face stiffener 120 further includes a bottom face stiffener 121.

The bottom face stiffener 121 is installed on a lower end of the end face stiffener 120 such that its lower face formed on the same plane as a lower face (bottom face) of the prestressed concrete beam 200 is exposed, and may also be made of a steel plate.

The bottom face stiffener 121 may be integrally fabricated with the end face stiffener 120 when the end face stiffener 120 is fabricated.

The bottom face stiffener 121 functions to more effectively transmit the stress, which is transmitted from the prestressed concrete beam 200, to the target structure along with the end face stiffener 120, and to support a bottom face of the end of the prestressed concrete beam 200.

Thus, it can be found that the bottom face stiffener 121 is very effective for reinforcement of the end of the prestressed concrete beam 200.

The bottom face stiffener 121 is also additionally provided with studs 111, shear connectors, on a top face thereof. The studs 111 are buried in the prestressed concrete beam 200, so that the prestressed concrete beam connecting stiffener 100 of the present invention is also able to be effectively merged (integrated) into the prestressed concrete beam 200.

Third Embodiment

Figure 2C:
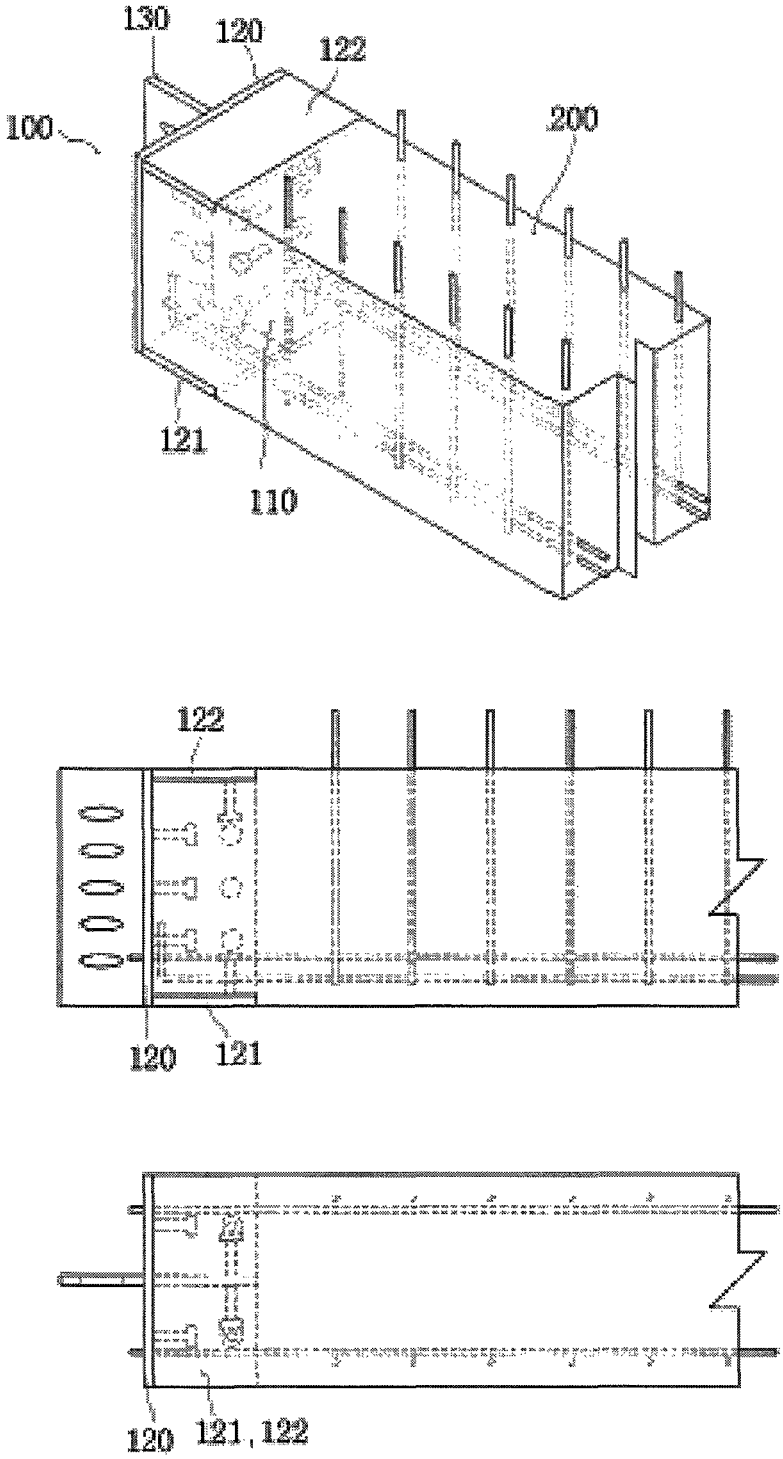

The prestressed concrete beam connecting stiffener 100 of the present invention as illustrated in FIG. 2*c* is basically identical to that of the first or second embodiment, but different from that of the first or second embodiment in that the end face stiffener 120 further includes a top face stiffener 122.

The top face stiffener 122 is installed on an upper end of the end face stiffener 120 such that its top face formed on the same plane as a top face of the prestressed concrete beam 200 is exposed, and may also be made of a steel plate.

The top face stiffener 122 may be integrally fabricated with the end face stiffener 120 along with the bottom face stiffener 121 when the end face stiffener 120 is fabricated.

The top face stiffener 122 more effectively transmits the stress, which is transmitted from the prestressed concrete beam 200, to the target structure along with the end face stiffener 120 and the bottom face stiffener 121, and encloses the end of the prestressed concrete beam 200 along with the bottom face stiffener 121.

Thus, it can be found that the top face stiffener 122 is still more effective for reinforcement of the end of the prestressed concrete beam 200 due to an effect of restricting the end of the prestressed concrete beam 200.

The top face stiffener 122 is also additionally provided with studs 111, shear connectors, on a bottom face thereof. The studs 111 are buried in the prestressed concrete beam 200, so that the prestressed concrete beam connecting stiffener 100 of the present invention is also able to be effectively merged (integrated) into the prestressed concrete beam 200.

Fourth Embodiment

Figure 2D:
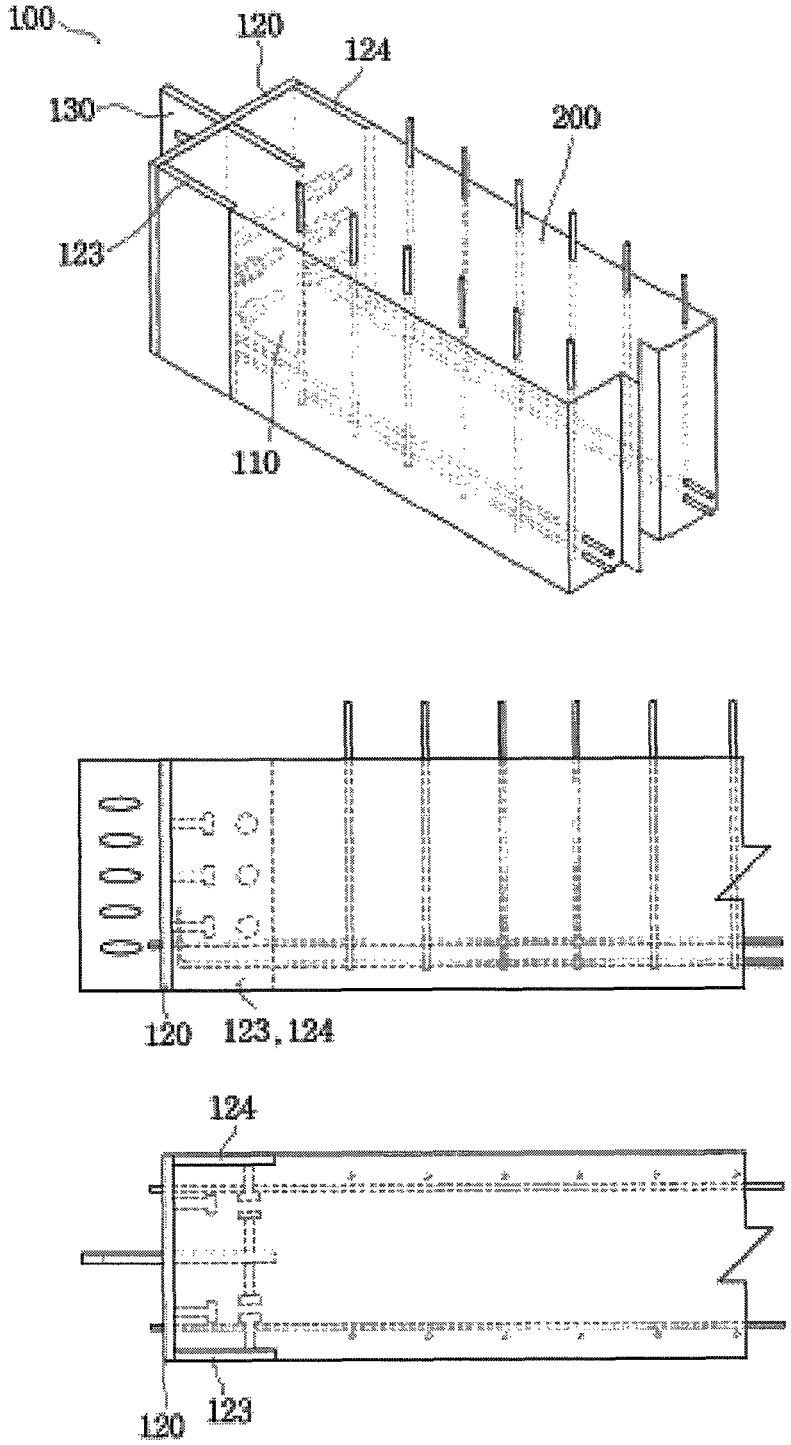

The prestressed concrete beam connecting stiffener 100 of the present invention as illustrated in FIG. 2*d* is basically identical to that of the first embodiment, but different from that of the first embodiment in that the end face stiffener 120 further includes lateral face stiffeners 123 and 124.

The lateral face stiffeners 123 and 124 are installed on opposite sides of the end face stiffener 120 such that their lateral faces formed on the same plane as opposite lateral faces of the prestressed concrete beam 200 are exposed, and may also be made of a steel plate.

The lateral face stiffeners 123 and 124 may be integrally fabricated with the end face stiffener 120 when the end face stiffener 120 is fabricated.

The lateral face stiffeners 123 and 124 function to more effectively transmit the stress, which is transmitted from the prestressed concrete beam 200, to the target structure along with the end face stiffener 120, and to support opposite lateral faces of the end of the prestressed concrete beam 200.

Thus, it can be found that the lateral face stiffeners 123 and 124 are effective for reinforcement of the end of the prestressed concrete beam 200.

Each of the lateral face stiffeners 123 and 124 is also additionally provided with studs 111, shear connectors, on an inner lateral face thereof. The studs 111 are buried in the prestressed concrete beam 200, so that the prestressed concrete beam connecting stiffener 100 of the present invention is also able to be effectively merged (integrated) into the prestressed concrete beam 200.

Furthermore, the embodiment of FIG. 2*d* has been described on the basis of the first embodiment, but it may be applied to the second and third embodiments.

In other words, the prestressed concrete beam connecting stiffener 100 of the present invention may be configured so that the lateral face stiffeners 123 and 124 are installed on the bottom face stiffener 121 and/or the top face stiffener 122, and that the lateral face stiffeners 123 and 124 are installed on both or one of the lateral faces of the end of the prestressed concrete beam 200.

Fifth Embodiment

Figure 2E:
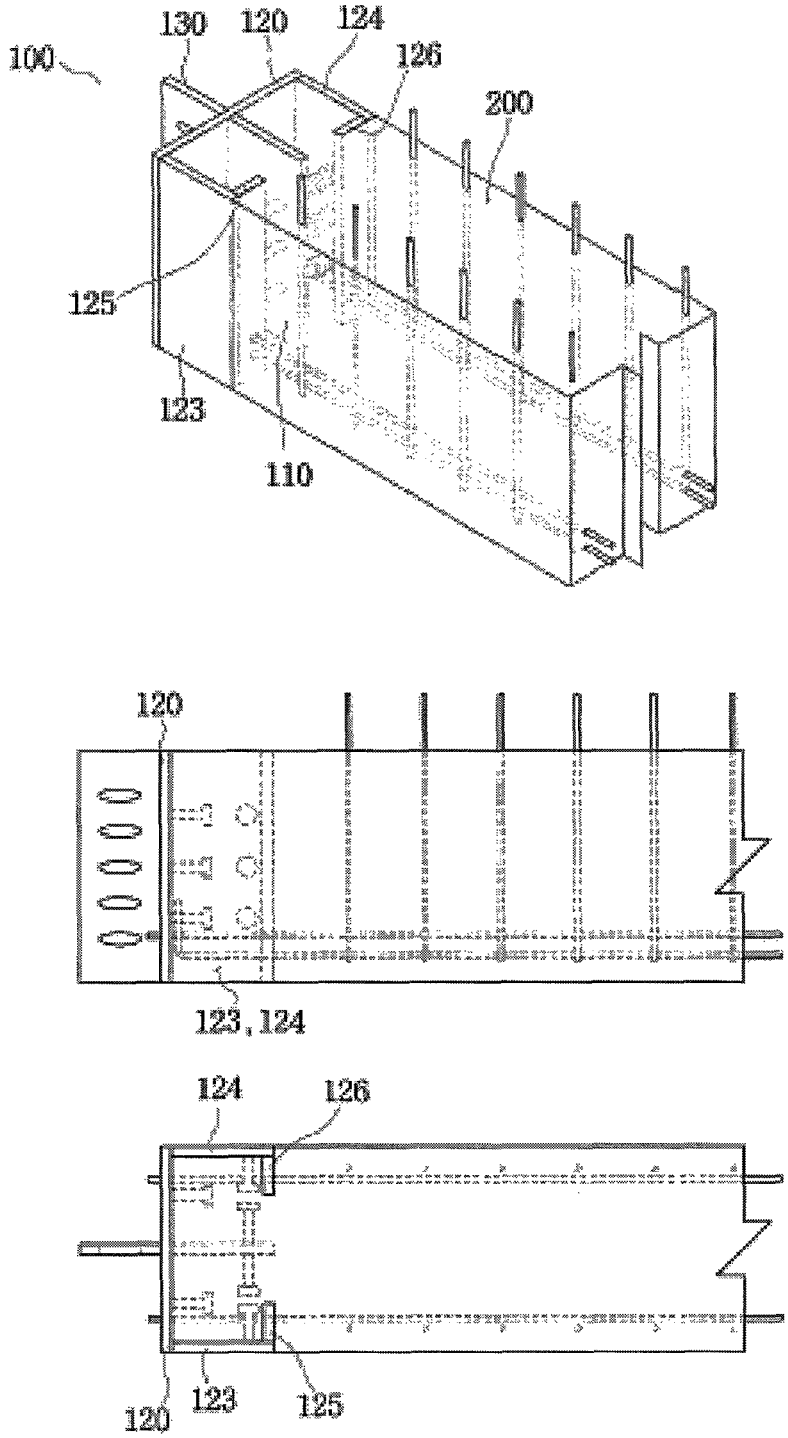

The prestressed concrete beam connecting stiffener 100 of the present invention as is illustrated in FIG. 2*e* is basically identical to that of the fourth embodiment, but it is different from that of the first embodiment in that angled stiffeners 125 and 126 are additionally formed on the lateral face stiffeners 123 and 124 of the end face stiffener 120 so as to be buried in the prestressed concrete beam, respectively.

In detail, the angled stiffeners 125 and 126 function as a hook, and extend from respective ends of the lateral face stiffeners 123 and 124 into the prestressed concrete beam 200, so that they serve to complement attachability, particularly, when the lateral face stiffeners 123 and 124 are installed independently.

The angled stiffeners 125 and 126 are made of a steel plate, and may be integrally formed with the lateral face stiffeners.

Furthermore, the angled stiffeners 125 and 126 may be installed on the top and bottom face stiffeners 121 and 122.

Method of Constructing the Prestressed Concrete Beam Connecting Stiffener 100 According to the Target Structure 300

Figure 3:
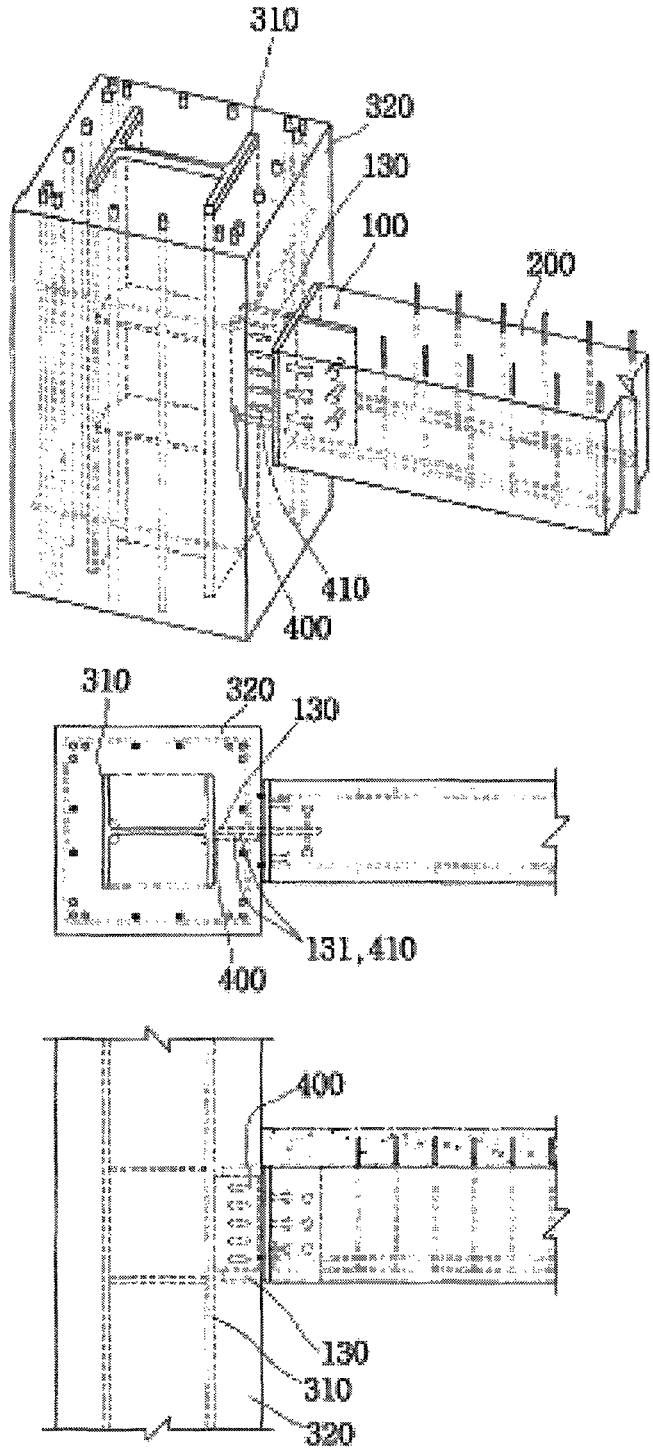
FIGS. 3, 4, 5, 6, 7, 8 and 9 illustrate examples of connection of a prestressed concrete beam connecting stiffener of the present invention to a target structure.
Figure 4:
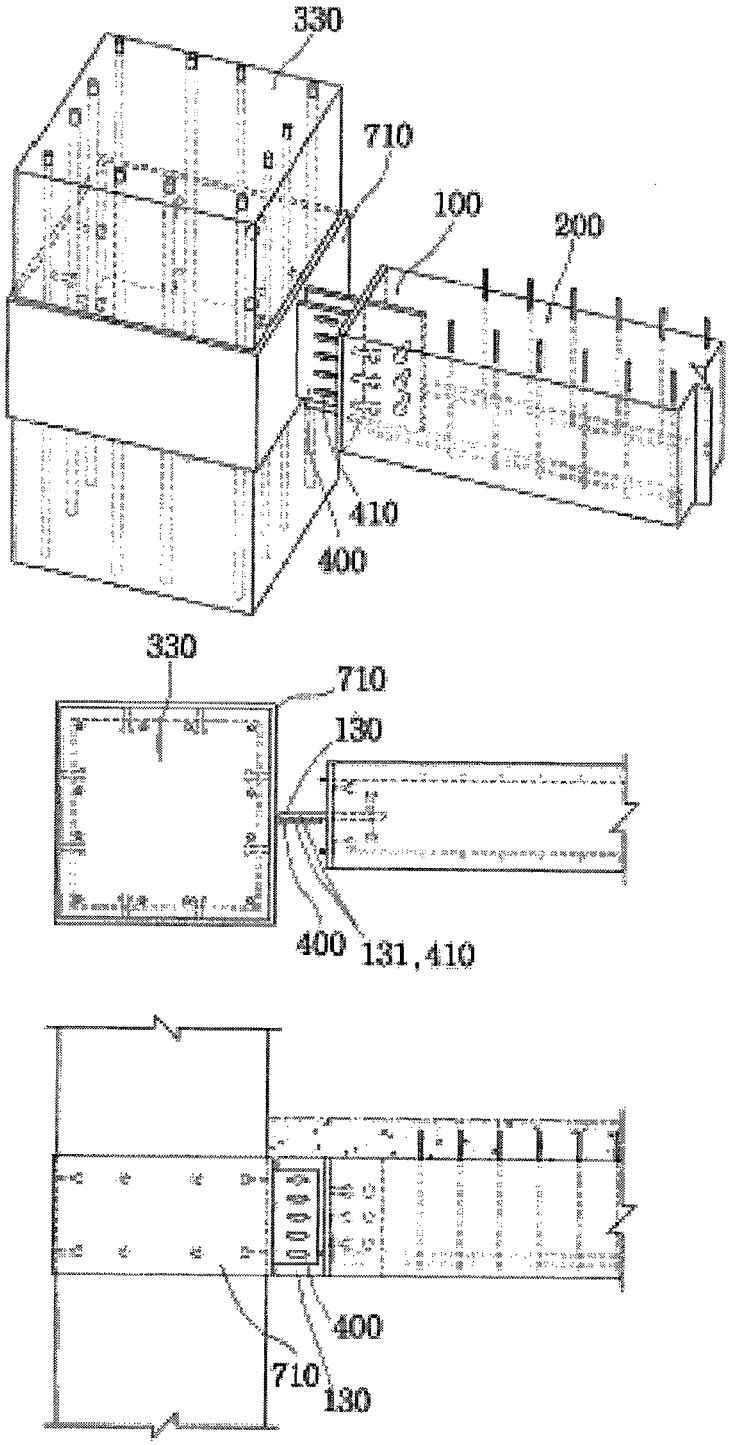

FIGS. 3 and 4 illustrate the state where the prestressed concrete beam connecting stiffener 100 of the present invention is connected to a column structure as the target structure. io First, FIG. 3 illustrates the state where the prestressed concrete beam connecting stiffener 100 according to the first embodiment of the present invention is connected to either a steel column 310 or a steel reinforced concrete (SRC) column structure 320 where a steel column is covered with concrete, which acts as a column structure.

Furthermore, the prestressed concrete beam connecting stiffener 100 according to the second to fifth embodiments may be used. However, the following description will be made on the basis of the first embodiment.

First, a steel column is installed as a column structure, and then a connecting member 400 is installed on a flange of the steel column.

The connecting member 400 is fabricated in a shape similar to the joint stiffener 130 of the prestressed concrete beam connecting stiffener 100 according to the first embodiment.

That is, the connecting member 400 uses a steel plate in which bolt holes 410 are formed as elliptical slots.

The connecting member 400 and the joint stiffener 130 are mechanically fastened to each other by overlapping with each other, inserting bolts into the communicating bolt holes 131 and 410, and securing the bolts using nuts (fasteners). Thereby, it can be found that both are easily connected.

Since the bolt holes are elliptical slots, the connecting member 400 and the joint stiffener 130 are able to undergo positional adjustment when connected, so that constructability can be prevented from being degraded by an error in installation.

Furthermore, the joint stiffener 130 may be mechanically fastened to the connecting member 400 using only some of the bolt holes, and then both may be connected by welding.

Both of the joint stiffener 130 and the connecting member 400 may be connected by welding without using the bolt holes. This ultimately need only be understood as the purpose of eliminating the mismatch between the bolt hole and the fastener caused by an error in construction.

However, the following description will be merely made on the basis of the mechanical fastening using the bolt holes.

Further, in the case of the steel column 310, a steel stiffener may be additionally installed between the flanges of the steel column 310 that is a place where the connecting member 400 is installed in order to support the stress of the connecting member 400 transmitted from the joint stiffener 130.

In the case of the SRC column structure 130 covered with the concrete, the steel stiffener, the connecting member 400, and the joint stiffener 130 fastened to the connecting member 400 may be previously installed on the steel column 310, and then the joint stiffener 130 may be welded to the end face stiffener 120 of the present invention.

Next, the prestressed concrete beam 200 having the prestressed concrete beam connecting stiffener 100 of the present invention is installed on the target structure 300. In this state, a floor slab for constructing a building is formed. Thereby, the construction of the building can be finally completed.

FIG. 4 illustrates the state where the prestressed concrete beam connecting stiffener 100 according to the first embodiment of the present invention is connected to either a reinforced concrete (RC) column structure or a prestressed concrete (PC) column structure 330 which acts as a column structure.

The prestressed concrete beam connecting stiffener 100 according to the second to fifth io embodiments may also be used. However, the following description will be made on the basis of the first embodiment.

First, a ring type stiffener 500 such as a steel ring, which is installed so as to surround a place where the prestressed concrete beam 200 is to be connected, is set for the RC column structure or the PC column structure 330, and the connecting member 400 is installed on the ring type stiffener 500 as in FIG. 3.

The connecting member 400 and the joint stiffener 130 of the present invention are mechanically fastened to each other by overlapping with each other, inserting bolts into the communicating bolt holes 131 and 410, and securing the bolts using nuts.

FIGS. 5, 6, 7, 8 and 9 illustrate the state where the prestressed concrete beam connecting stiffener 100 of the present invention is connected to a girder as a target structure.

Figure 5:
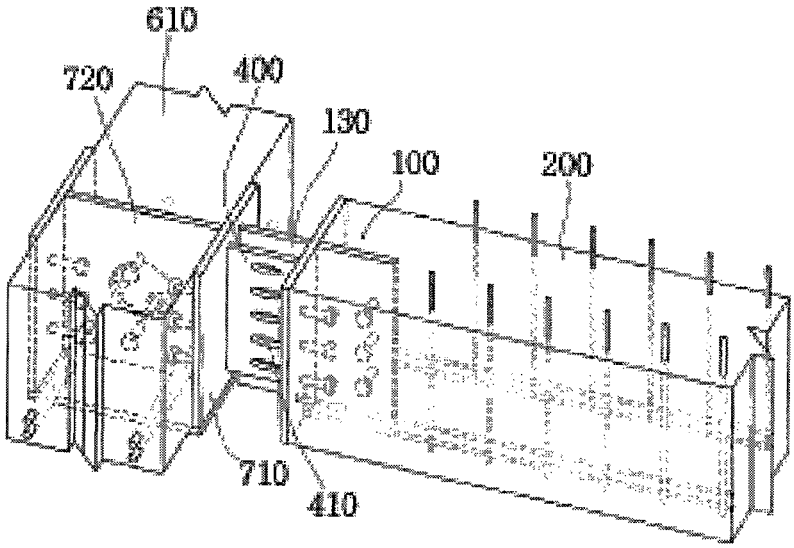
Figure 5:
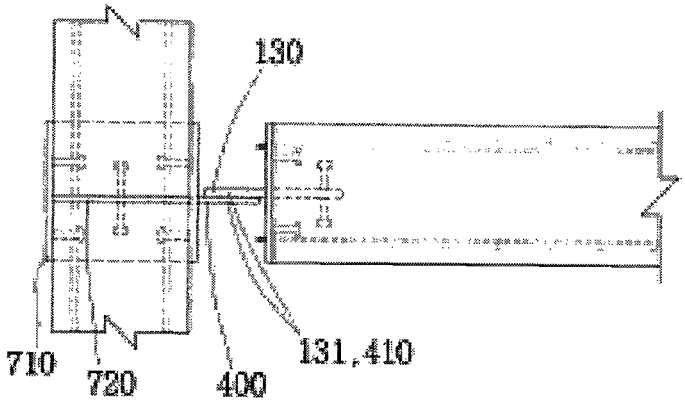
Figure 5:
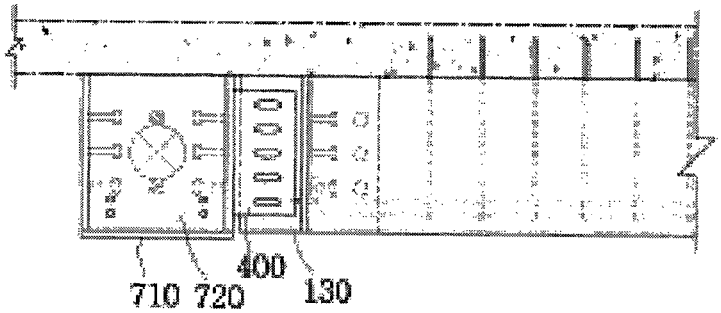

First, FIG. 5 illustrates the state where the prestressed concrete beam connecting stiffener 100 of the present invention is connected to a PC or RC girder 610 as a girder 600 covered with concrete.

Furthermore, the prestressed concrete beam connecting stiffener 100 according to the second to fifth embodiments may also be used. However, the following description will be made on the basis of the first embodiment.

First, circumference reinforcing plates 710 are installed on lateral and bottom faces of the PC or RC girder 610 so as to surround a place where the prestressed concrete beam 200 is to be connected, and a vertical reinforcing plate 720 is installed between the circumference reinforcing plates across the PC or RC girder 610. Thereby, the stress transmitted from the prestressed concrete beam 200 is effectively supported.

Next, the connecting member 400 is installed on the circumference reinforcing plate such that the joint stiffener 130 of the prestressed concrete beam 200 can also be connected to the connecting member 400 by bolts and nuts.

Figure 6:
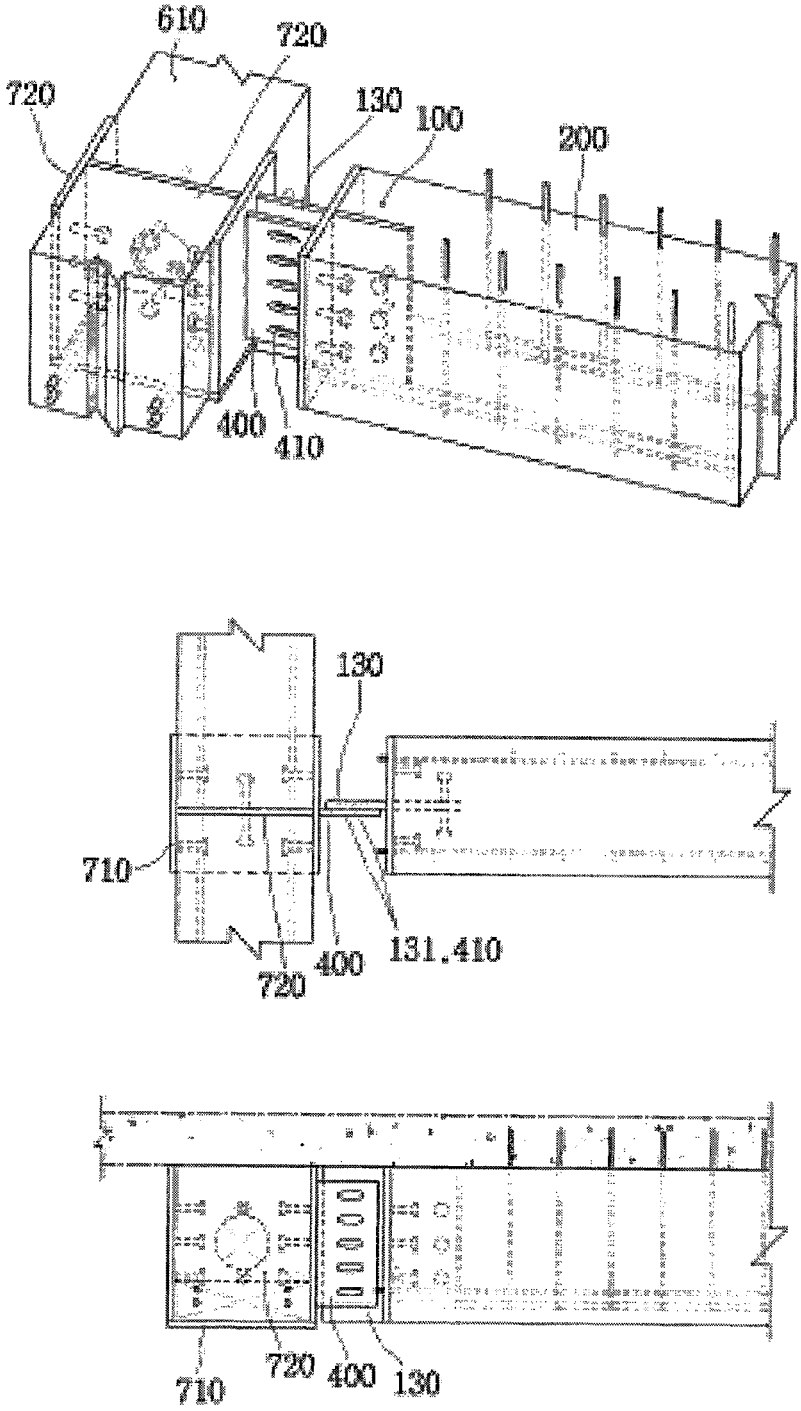

FIG. 6 illustrates a modification of FIG. 5 in which the prestressed concrete beam connecting stiffener 100 of the present invention is connected to a PC or RC girder 610 as a girder covered with concrete.

That is, the embodiment of FIG. 6 is identical to the embodiment of FIG. 5 in that the circumference reinforcing plates 710 are installed on lateral and bottom faces of the PC or RC girder 610 so as to surround a place where the prestressed concrete beam 200 is to be connected, but different from the embodiment of FIG. 5 in that a vertical reinforcing plate is installed between the circumference reinforcing plates across the PC or RC girder 610 at a different height. In detail, the height of the vertical reinforcing plate can be regarded to be reduced so as to avoid interference in consideration of the arrangement of reinforcements and tendons disposed at a lower portion of the girder.

The connecting member 400 is installed on the circumference reinforcing plate 710 such that the joint stiffener 130 of the prestressed concrete beam 200 can also be connected to the connecting member 400 by bolts and nuts.

Figure 7:
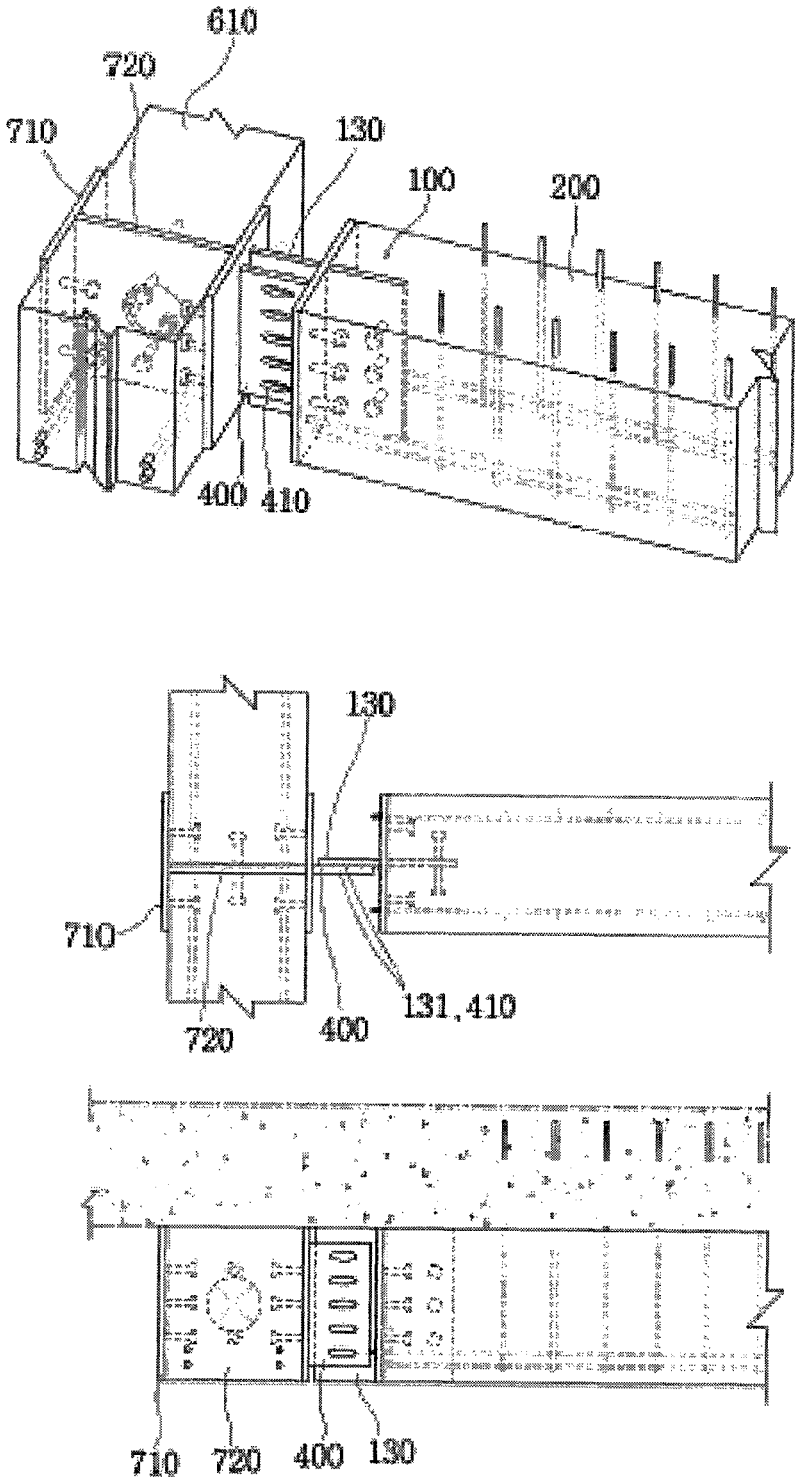

FIG. 7 illustrates another modification of FIG. 5 in which the prestressed concrete beam connecting stiffener 100 of the present invention is connected to a PC or RC girder 610 as a girder covered with concrete.

Here, circumference reinforcing plates 710 are installed on lateral faces of the PC or RC girder 610 so as to surround a place where the prestressed concrete beam 200 is to be connected, but no circumference reinforcing plate 710 is installed on a bottom face of the PC or RC girder 610. Further, a vertical reinforcing plate 720 is installed between the circumference reinforcing plates across the PC or RC girder 610. Thereby, the stress transmitted from the prestressed concrete beam 200 is effectively supported.

The connecting member 400 is installed on the circumference reinforcing plate 710 such that the joint stiffener 130 of the prestressed concrete beam 200 can also be connected to the is connecting member 400 by bolts and nuts.

Figure 8:
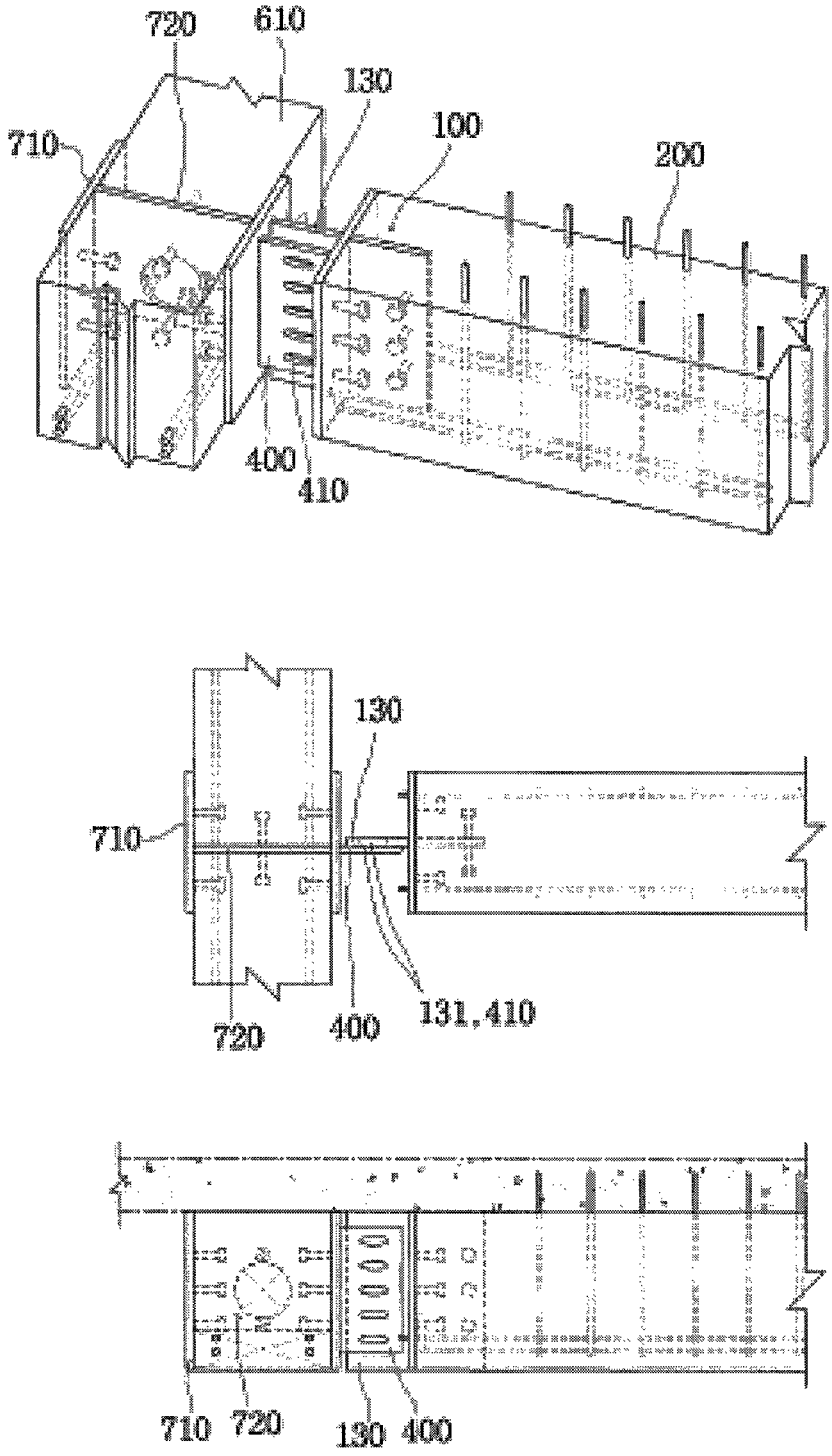

FIG. 8 illustrates a modification of FIG. 7 in which the prestressed concrete beam connecting stiffener 100 of the present invention is connected to a PC or RC girder 610 as a girder covered with concrete.

Here, circumference reinforcing plates 710 are installed on lateral faces of the PC or RC girder 610 so as to surround a place where the prestressed concrete beam 200 is to be connected, but no circumference reinforcing plate 710 is installed on a bottom face of the PC or RC girder 610. Further, a vertical reinforcing plate 720 is installed between the circumference reinforcing plates across the PC or RC girder 610 at a different height.

The connecting member 400 is installed on the circumference reinforcing plate 710 such that the joint stiffener 130 of the prestressed concrete beam 200 can also be connected to the connecting member 400 by bolts and nuts.

Figure 9:
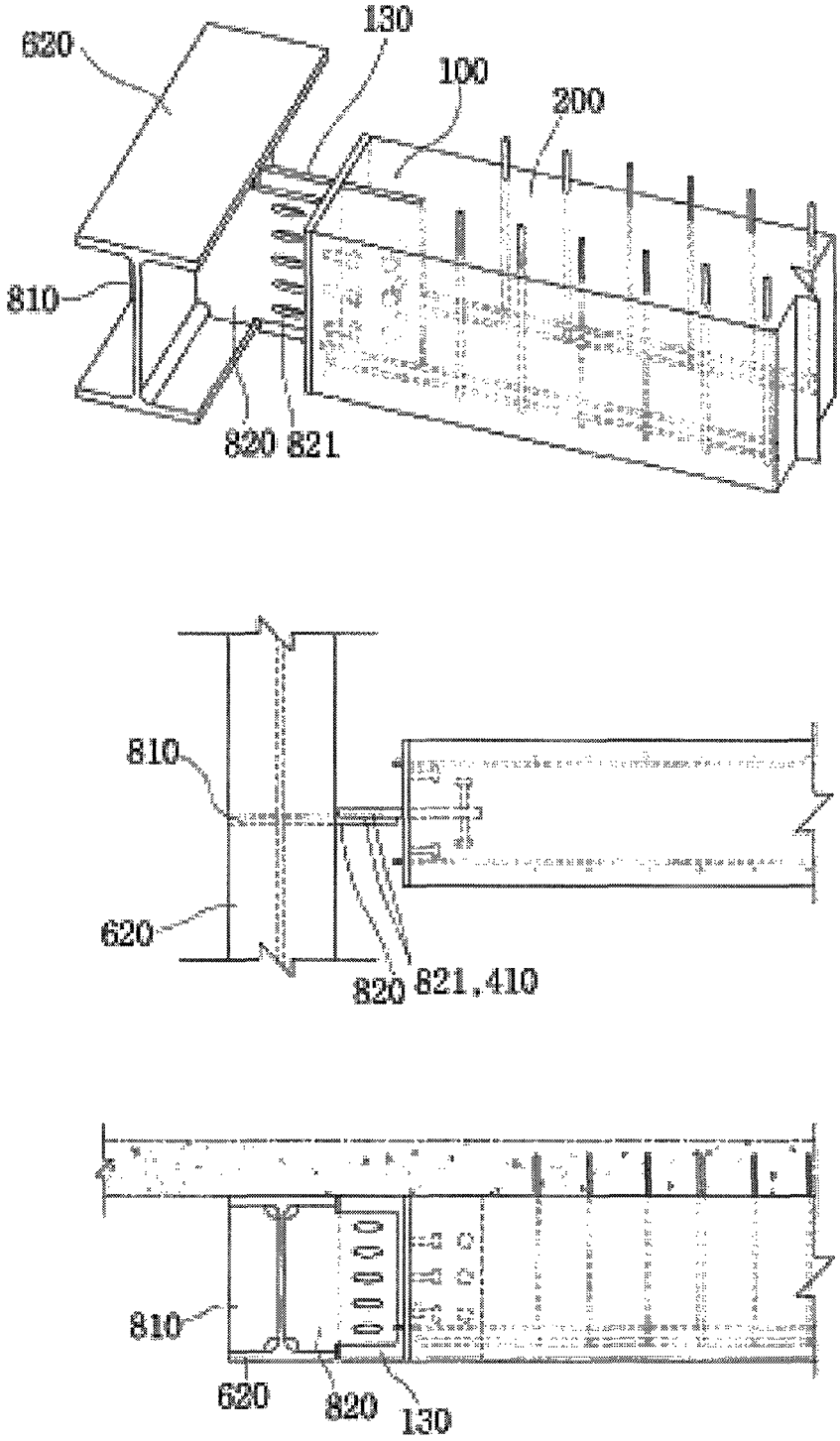

FIG. 9 illustrates the state where the prestressed concrete beam connecting stiffener 100 of the present invention is connected to a steel girder 620 as a girder (wherein the steel girder may be an SRC girder further covered with concrete as in the girder of FIG. 3).

Here, the steel girder 620 is provided with a vertical plate 810 on one side of a web thereof and a joint vertical plate 820 as a connecting member in which elliptical slots 821 are formed and which is formed at a place where it is connected with the prestressed concrete beam 200.

The joint stiffener 130 of the prestressed concrete beam 200 is also connected to the joint vertical plate 820 by bolts and nuts.

In the present invention, the circumference reinforcing plate 710, the vertical reinforcing plate 720, the vertical plate 810, and the joint vertical plate 820 are commonly called connecting members 710, 720, 810, and 820. It can be found that the circumference reinforcing plate 710, the vertical reinforcing plate 720, the vertical plate 810, and the joint vertical plate 820 are formed on a surface (circumferential surface) or in the interior of the girder or the column structure.

Accordingly, in the present invention, the target structure is generally divided into the column structure and the girder. However, the target structure includes a structure on which another connector, which is not described in the present invention, is mounted.

According to the present invention, a conventional prestressed concrete beam can be more easily connected to a target structure. A structure can be safely constructed by smooth transmission of an applied load. It is possible to promote connectability as well as reinforce an end of the prestressed concrete beam, so that very effective prestressed concrete beam connecting work and structure construction using the same are made possible.

The embodiments of the invention described above and illustrated in the drawings should not be interpreted as limiting for the technical spirit of the invention. It will be understood by those skilled in the art that the scope of the present invention should be limited by the following claims only, and various changes and modifications can be made within the technical spirit of the present invention. Accordingly, the changes and modifications fall within the scope of the present invention as long as they are apparent to those skilled in the art.

What is claimed is:

1. A stiffener for connecting a prestressed concrete beam, comprising:

a buried stiffener that is installed on an end face of the prestressed concrete beam covered with concrete so as to protrude inwards from substantially a middle of the end face of the prestressed concrete beam to transmit a stress transmitted from the prestressed concrete beam, and that has shear connectors disposed on two opposite sides of the buried stiffener so as to extend into the prestressed concrete beam;

an end face stiffener that is connected to a front face of the buried stiffener, that is installed so as to be in contact with the end face of the prestressed concrete beam, and that has shear connectors so as to extend into the prestressed concrete beam;

a bottom face stiffener that extends from a lower portion of the end face stiffener to be integrally installed on a bottom face of the prestressed concrete beam, and that has shear connectors so as to extend into the prestressed concrete beam, wherein the bottom face stiffener is perpendicular to the buried stiffener; and a joint stiffener that is formed in a plate shape, and that protrudes from a front face of the end face stiffener in a lengthwise direction of the prestressed concrete beam, wherein the buried stiffener, the end face stiffener, the bottom face stiffener, and the joint stiffener are fabricated in one piece.

2. The stiffener as set forth in claim 1, wherein the end face stiffener further includes lateral face stiffeners, both of which integrally extend to be installed on both lateral faces of the prestressed concrete beam, and one of which integrally extends to be installed on one lateral face of the prestressed concrete beam.

3. The stiffener as set forth in claim 2, wherein the lateral face stiffeners further include angled stiffeners at one ends thereof so as to be buried in the prestressed concrete beam.

4. The stiffener as set forth in claim 1, wherein:

the joint stiffener includes bolt holes, overlaps with a connecting member that protrudes from a target structure including a girder or a column structure and includes bolt holes, and is connected with the connecting member by mechanical fastening of fasteners including bolts and nuts; or the joint stiffener overlaps with a connecting member that protrudes from a target structure including a girder or a column structure, and is connected with the connecting member by welding.

5. A method of constructing a structure using a stiffener for connecting a prestressed concrete beam, the method comprising:

installing a target structure including a girder or a column structure;

installing a connecting member formed on or in the target structure;

connecting the prestressed concrete beam to the connecting member using the stiffener formed on an end face of the prestressed concrete beam, wherein the prestressed concrete beam includes:

a buried stiffener that is installed on the end face of the prestressed concrete beam covered with concrete so as to protrude inwards from substantially a middle of the end face of the prestressed concrete beam to transmit a stress transmitted from the prestressed concrete beam, and that has shear connectors disposed on two opposite sides of the buried stiffener so as to extend into the prestressed concrete beam;

an end face stiffener that is connected to a front face of the buried stiffener, that is installed so as to be in contact with the end face of the prestressed concrete beam, and that has shear connectors so as to extend into the prestressed concrete beam;

a bottom face stiffener that extends from a lower portion of the end face stiffener to be integrally installed on a bottom face of the prestressed concrete beam, and that has shear connectors so as to extend into the prestressed concrete beam, wherein the bottom face stiffener is perpendicular to the buried stiffener; and a joint stiffener that is formed in a plate shape, and that protrudes from a front face of the end face stiffener in a lengthwise direction of the prestressed concrete beam, wherein the buried stiffener, the end face stiffener, the bottom face stiffener, and the joint stiffener are fabricated in one piece; and forming a floor slab on the prestressed concrete beam.

6. The method as set forth in claim 5, wherein the end face stiffener further includes lateral face stiffeners, both of which integrally extend to be installed on both lateral faces of the prestressed concrete beam, and one of which integrally extends to be installed on one lateral face of the prestressed concrete beam.

7. The method as set forth in claim 6, wherein the lateral face stiffeners further include angled stiffeners at one ends thereof so as to be buried in the prestressed concrete beam.

8. The method as set forth in claim 7, wherein:

the joint stiffener includes bolt holes, overlaps with a connecting member that protrudes from a target structure including a girder or a column structure and includes bolt holes, and is connected with the connecting member by mechanical fastening of fasteners including bolts and nuts; or the joint stiffener overlaps with the connecting member that protrudes from the target structure, and is connected with the connecting member by welding.

* * * * *